US008161685B2

(12) United States Patent
Salgado

(10) Patent No.: US 8,161,685 B2
(45) Date of Patent: Apr. 24, 2012

(54) DOOR DRAFT EXCLUDER

(76) Inventor: Anthony J. Salgado, Richmond, IL (US)

( * ) Notice: Subject to any disclaimer, the term of this patent is extended or adjusted under 35 U.S.C. 154(b) by 185 days.

(21) Appl. No.: 12/772,218

(22) Filed: May 2, 2010

(65) Prior Publication Data

US 2011/0265388 A1 Nov. 3, 2011

(51) Int. Cl.
*E06B 1/70* (2006.01)

(52) U.S. Cl. ..... 49/470; 49/70; 49/467; 160/40; 160/41; 160/42; 160/43; 292/288; 292/DIG. 15; 292/140; 292/80; 292/DIG. 53; 292/DIG. 54

(58) Field of Classification Search ..... 292/288, 292/DIG. 15, 140, 1, DIG. 53, DIG. 54, 80; 160/40–43; 49/70, 467, 469, 470
See application file for complete search history.

(56) References Cited

U.S. PATENT DOCUMENTS

| | | | | | |
|---|---|---|---|---|---|
| 604,301 | A | * | 5/1898 | Clabaugh | 15/257.1 |
| 712,240 | A | * | 10/1902 | Barnes et al. | 49/499.1 |
| 914,179 | A | * | 3/1909 | Patterson | 292/80 |
| 1,218,331 | A | | 3/1917 | Smith | |
| 1,550,533 | A | | 8/1925 | Geake | |
| 1,671,349 | A | * | 5/1928 | Crist | 49/493.1 |
| 1,883,609 | A | * | 10/1932 | Dennis | 49/495.1 |
| 2,172,610 | A | * | 9/1939 | Frank | 292/288 |
| 2,256,276 | A | * | 9/1941 | Bright | 49/490.1 |
| 2,347,158 | A | * | 4/1944 | Spraragen | 49/479.1 |
| 3,555,734 | A | | 1/1971 | Hirtle et al. | |
| 3,987,587 | A | * | 10/1976 | Miller | 49/493.1 |
| 4,089,136 | A | | 5/1978 | Lapinski et al. | |
| 4,122,632 | A | * | 10/1978 | Dixon | 49/470 |
| 4,447,989 | A | * | 5/1984 | Mailand et al. | 49/482.1 |
| 4,691,478 | A | * | 9/1987 | Lorg | 49/499.1 |
| 4,765,094 | A | * | 8/1988 | Gemmell | 49/475.1 |
| 5,056,263 | A | * | 10/1991 | Bies | 49/484.1 |
| 5,072,952 | A | * | 12/1991 | Irrgeher et al. | 277/652 |
| 5,150,544 | A | * | 9/1992 | Burnett | 49/493.1 |
| 5,475,946 | A | * | 12/1995 | Howe | 49/470 |
| 5,475,948 | A | * | 12/1995 | Parke | 49/506 |
| 5,577,349 | A | | 11/1996 | Rissone | |
| 6,560,932 | B2 | * | 5/2003 | Heroux | 49/469 |
| 7,117,641 | B2 | * | 10/2006 | Lee | 52/2.14 |
| D605,032 | S | * | 12/2009 | Bushey | D8/402 |
| 7,891,136 | B1 | * | 2/2011 | Heroux | 49/470 |
| 8,056,287 | B2 | * | 11/2011 | DeMello | 49/482.1 |
| 2002/0062597 | A1 | * | 5/2002 | Heroux | 49/472 |
| 2005/0235561 | A1 | * | 10/2005 | Bushey | 49/70 |
| 2006/0032144 | A1 | | 2/2006 | Heroux | |
| 2007/0094934 | A1 | * | 5/2007 | Albanese et al. | 49/475.1 |

* cited by examiner

*Primary Examiner* — Katherine W Mitchell
*Assistant Examiner* — Clarence W Mayott, III
(74) *Attorney, Agent, or Firm* — Christopher Wood; Premier Law Group, PLLC

(57) ABSTRACT

A draft excluder for excluding drafts between a door and the floor. The draft excluder is made up of an elongated angled bracket, at least one clip, a flexible covering, and an elongated weight. The flexible covering can take the form of a cloth covering. The elongated angled bracket defines first and second sidewalls with an interior angle there-between. The first and second sidewalls respectively define first and second elongated terminal edges. During normal use the at least one clip holds the first sidewall of the bracket to the bottom of a door such that the interior angle faces downward and towards the floor beneath the door. The flexible covering defines a cover portion that extends between the first and second elongated terminal edges. The cover portion defines an interior surface and an exterior surface. The elongated weight is affixed to the interior surface of the cover portion.

3 Claims, 16 Drawing Sheets

| TABLE 1 | |
|---|---|
| # | Description |
| 100 | draft excluder |
| 120 | elongated angled bracket wherein 120t is a tapered version thereof |
| 140 | at least one clip |
| 150 | a flexible covering |
| 160 | an elongated weight; 160f and 160i being non-limiting variations thereof |
| 165 | granules or beads |
| 180 | first sidewall |
| 200 | second sidewall |
| 220 | interior angle |
| 240 | first elongated terminal edge |
| 260 | second elongated terminal edge |
| 280 | a door |
| 285 | bottom end of door 280 |
| 300 | interior surface of cover portion 360 |
| 320 | exterior surface of cover portion 360 |
| 340 | floor |
| 360 | cover portion located between first and second elongated terminal edges 240 and 260, respectively |
| 380 | direction arrow |
| 400 | direction arrow |
| 420 | sleeve |
| 440 | adhesive |
| 460 | virtual plane |

FIG. 11

DOOR DRAFT EXCLUDER

CROSS-REFERENCE TO RELATED APPLICATIONS

Not applicable.

STATEMENT REGARDING FEDERALLY SPONSORED RESEARCH OR DEVELOPMENT

Not Applicable.

FIELD OF THE INVENTION

The present invention relates to devices for reducing airflow beneath doors. More specifically, the invention is a draft excluder.

BACKGROUND OF THE INVENTION

U.S. Pat. No. 5,475,946 discloses a draught excluder comprising a gap sealing section fitted to the underside of a door edge using strips of bonding tape. The sealing section comprises two main webs, a mounting web and a sealing web, which are connected together along the length of the section by a hinged or weakened section. The mounting web comprises a generally thin flat flexible web for flush mounting the sealing section directly to the underside of a door edge. The sealing web is a generally curved or non-linear cross section for making contact with and freely sliding over floor surfaces including floor coverings and for actively mounting obstacles on the floor.

As noted in U.S. Pat. No. 5,475,946, existing methods of restricting draught and weather at the gap at the bottom of doors take several forms. One common method involves the manual placement of a device such as a soft flexible tubular container filled with sand, cloth or other filling so that the device may be manually pushed against the gap so that the device takes up the shape of the gap and restricts draught through the gap. Another common method uses a mounting mechanism which must be screwed to the face of the door so that the tubular section moves with the door.

U.S. Pat. No. 4,089,136 discloses a weather excluder for attachment at the foot of a door which includes a closure member capable of vertical movement towards the floor upon closing of the door and away from the floor upon opening the door, characterized in that two jamb engaging members are provided which each contact one of the jambs of the door and which each provide one stage in the vertical movement of the closure member.

U.S. Pat. No. 4,765,094 discloses a draught excluder for a door, the draught excluder comprises an elongated member having an outer surface which is at least partially flexible, and attachment means connected to the elongated member for releasably attaching the elongated member to the bottom of the door. The attachment means comprises a pair of resiliently extensible cords and a pair of rollers, and the elongated member comprises a hollow core located within a sleeve, both of which are permeable to gas, the core containing material for releasing a volatile pesticide.

SUMMARY OF THE INVENTION

A draft excluder for excluding drafts between the bottom of a door and the floor. The draft excluder is made up of an elongated angled bracket, at least one clip, a flexible covering, and an elongated weight. The flexible covering can take the form of a cloth covering. The elongated angled bracket defines first and second sidewalls with an interior angle there-between. The first and second sidewalls respectively define first and second elongated terminal edges. During normal use the at least one clip holds the first sidewall of the bracket to the bottom of a door such that the interior angle faces downward and towards the floor beneath the door. The flexible covering defines a cover portion that extends between the first and second elongated terminal edges. The cover portion defines an interior surface and an exterior surface. The elongated weight is affixed to the interior surface of the cover portion.

BRIEF DESCRIPTION OF THE DRAWINGS

FIG. 11 shows a table (Table 1) that lists reference numbers and their associated descriptions.

Similar reference characters denote corresponding features consistently throughout the attached drawings.

DETAILED DESCRIPTION OF THE PREFERRED EMBODIMENTS

Figure 1:
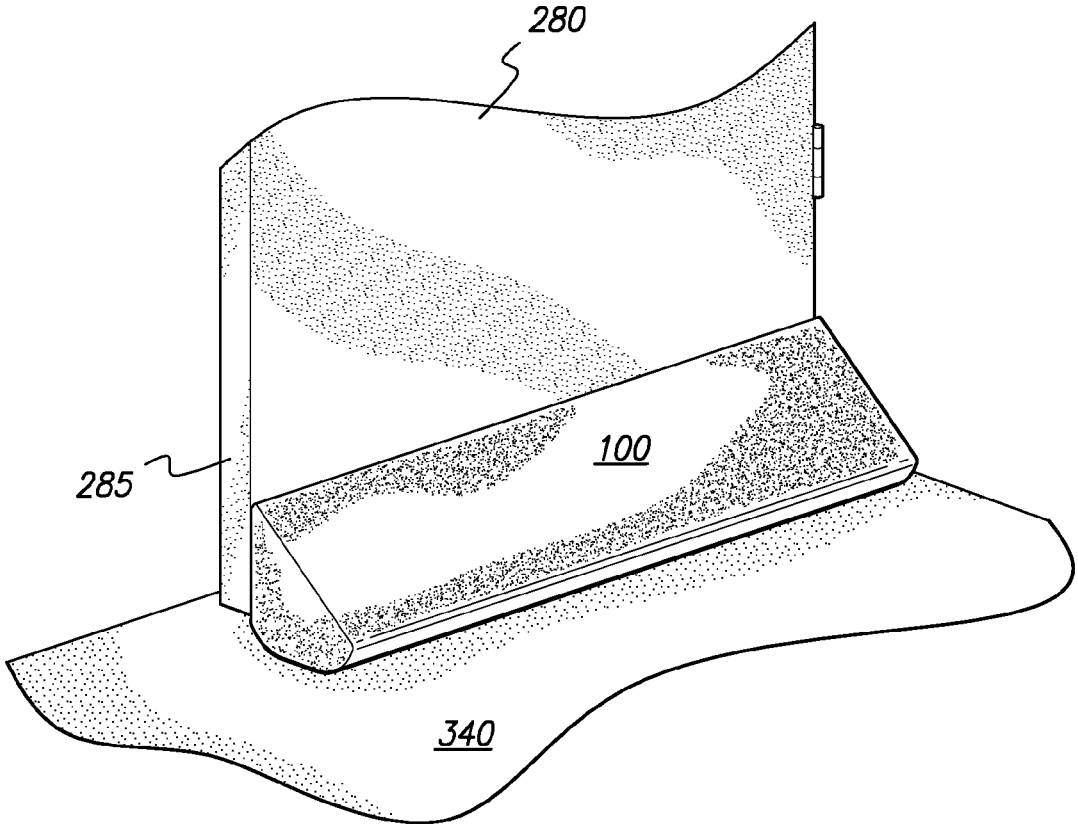
FIG. 1 shows a perspective environmental view of a draft excluder device fitted to the bottom of a door.

The present invention is directed to devices for reducing airflow beneath doors. More specifically, the invention is a draft excluder for restricting airflow underneath doors. The draft excluder of the present invention is denoted by the reference numeral 100 as a whole. Referring to the Figures in general, a summary of the component parts that make up various embodiments of the draft excluder 100 are listed in Table 1 (see FIG. 11).

The draft excluder 100 comprises an elongated angled bracket 120, at least one clip 140, a flexible covering 150, and an elongated weight 160. The bracket 120 is made up of first and second sidewalls 180 and 200, respectively, with an interior angle 220 there-between. The interior angle 220 is between 5° and 85°. In the alternative the interior angle 220 is between 10° and 60°; alternatively, the interior angle 220 is between 20° and 45°; alternatively, the interior angle 220 is between 25° and 35°; alternatively, the interior angle 220 is 45°. The first and second sidewalls 180 and 200 respectively define first and second elongated terminal edges 240 and 260, wherein the first and second elongated terminal edges 240 and 260 extend along at least a portion of the elongated bracket. The bracket 120 defines an open side between the first and second elongated terminal edges 240 and 260.

Figure 4:
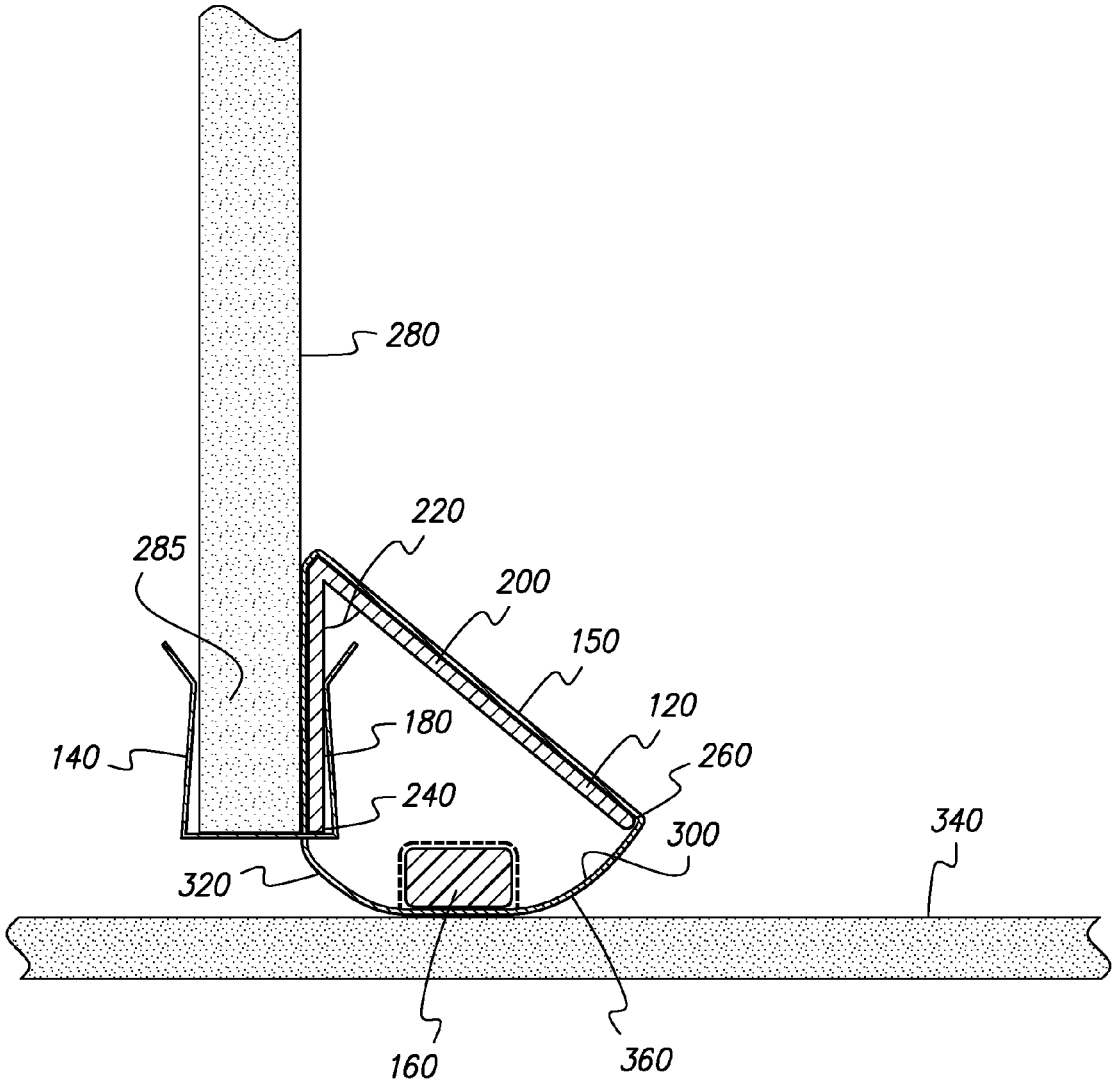
FIG. 4 shows a cross-section environmental view of a draft excluder along lines X-X of FIG. 2 according to the present invention.

In one embodiment the flexible covering 150 extends all the way round the elongated bracket 120 as shown, for example, in FIG. 4. The at least one clip 140 is inserted through the flexible covering 150. The at least one clip 140 holds the bracket 120 and flexible covering 150 to the bottom of a door.

The flexible covering 150 defines a cover portion 360 that extends between first and second sidewalls 180 and 200 of draft excluder 100. More specifically, the cover portion 360 extends between the first and second elongated terminal edges 240 and 260. The cover portion 360 defines an interior surface 300 and an exterior surface 320. The elongated weight 160 is affixed to the interior surface 320 of the cover portion 360 as shown, for example, in FIG. 4. More specifically, the elongated weight 160 is located at a point between the first and second sidewalls 180 and 200, and more particularly the weight 160 is located at a point between the first and second terminal edges 240 and 260. During normal operation of the draft excluder 100 the weight 160 remains affixed to the interior surface 320 and remains located between the first and second elongated terminal edges 240 and 260, respectively.

Referring to the Figures with regard to which FIG. 1 shows a perspective environmental view of the draft excluder 100 fitted to the bottom end 285 of door 280. The draft excluder 100 helps prevent air movement between the door 280 and the floor 340. Numeric labels shown in FIG. 1 are described in Table 1 (see FIG. 11).

Figure 2:
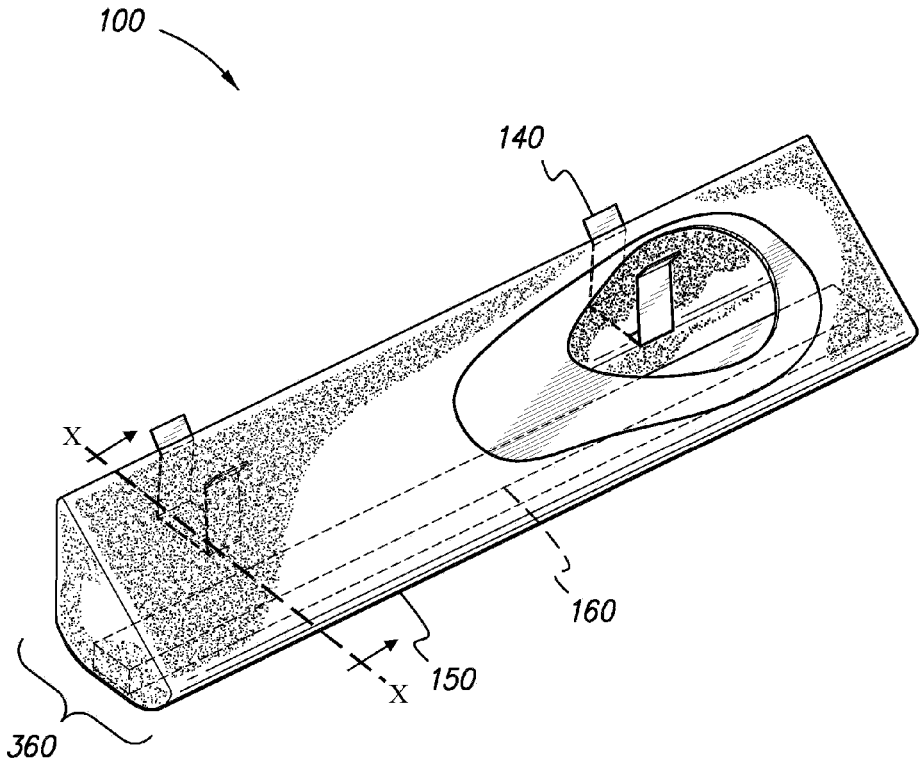
FIG. 2 shows a partially cut-away view of the draft excluder of FIG. 1 according to the present invention.

FIG. 2 shows a partially cut-away drawing of the draft excluder 100. The draft excluder 100 includes an elongated weight 160. Numeric labels shown in FIG. 2 are described in Table 1 (see FIG. 11).

Figure 3:
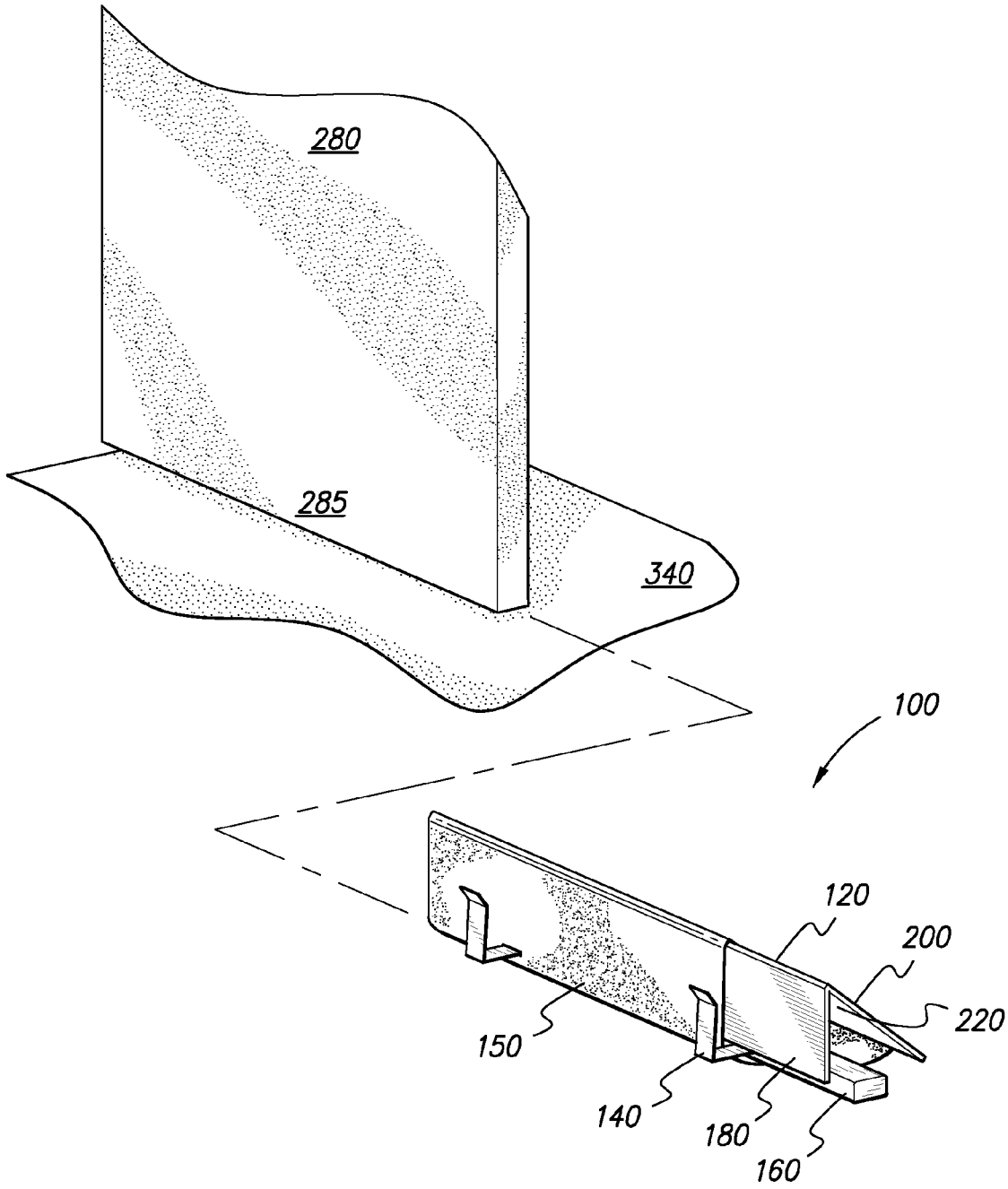
FIG. 3 shows an environmental view of the draft excluder of FIG. 1 with one end thereof partially cutaway.

FIG. 3 shows the draft excluder 100 with one end thereof partially cutaway. The draft excluder 100 is attached to the bottom end 285 of door 280 by a user (not shown); a user can, for example, slide the draft excluder 100 onto the bottom end 285 of a door 280. Numeric labels shown in FIG. 3 are described in Table 1 (see FIG. 11).

FIG. 4 shows a cross-section view of one embodiment of the draft excluder 100. The draft excluder 100 is shown clipped to the bottom end 285 of a door 280. The elongated weight 160 is shown affixed to the interior surface 300 of cover portion 360, wherein cover portion 360 forms part of the flexible cover 150. The elongated weight 160 is located between first and second sidewalls 180 and 200, and more specifically between first and second elongated terminal edges 240 and 260. The first and second sidewalls 180 and 200 function by limiting the travel of the cover portion 360 to keep weight 160 between first and second terminal edges 240 and 260 as door 280 is opened and closed in this manner the weight 160 is stopped from going under the bottom end of door 280. Also, the cover portion 360 is sufficiently deformable to allow the draft excluder 100 to be used on uneven floors and objects such as a door mat. Numeric labels shown in FIG. 4 are described in Table 1 (see FIG. 11).

Figure 4A:
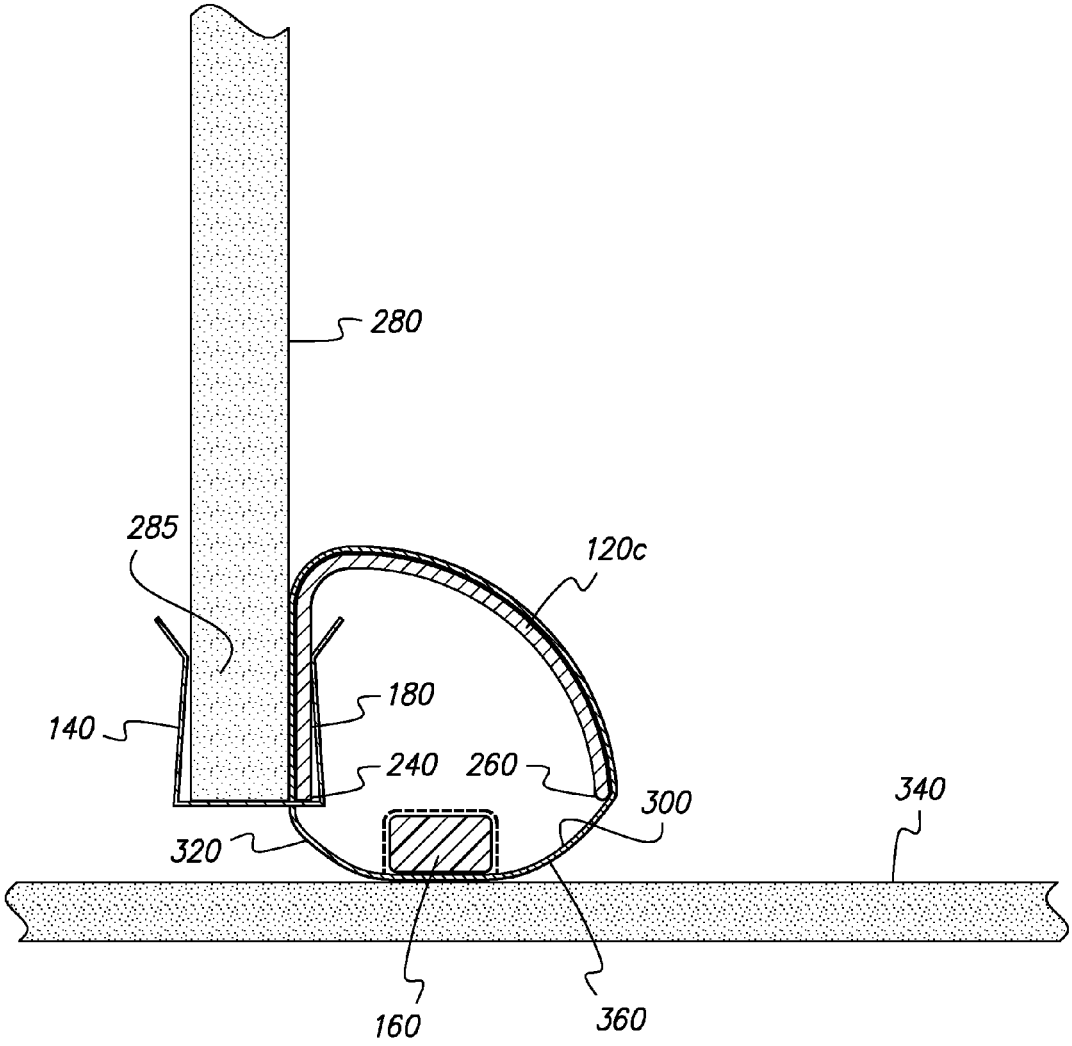
FIG. 4A shows a cross-section environmental view of the draft excluder of FIG. 4 but with an elongated bracket 120*c* having a curved profile in place of the elongated bracket 120 shown in FIG. 4, according to the present invention.
Figure 4B:
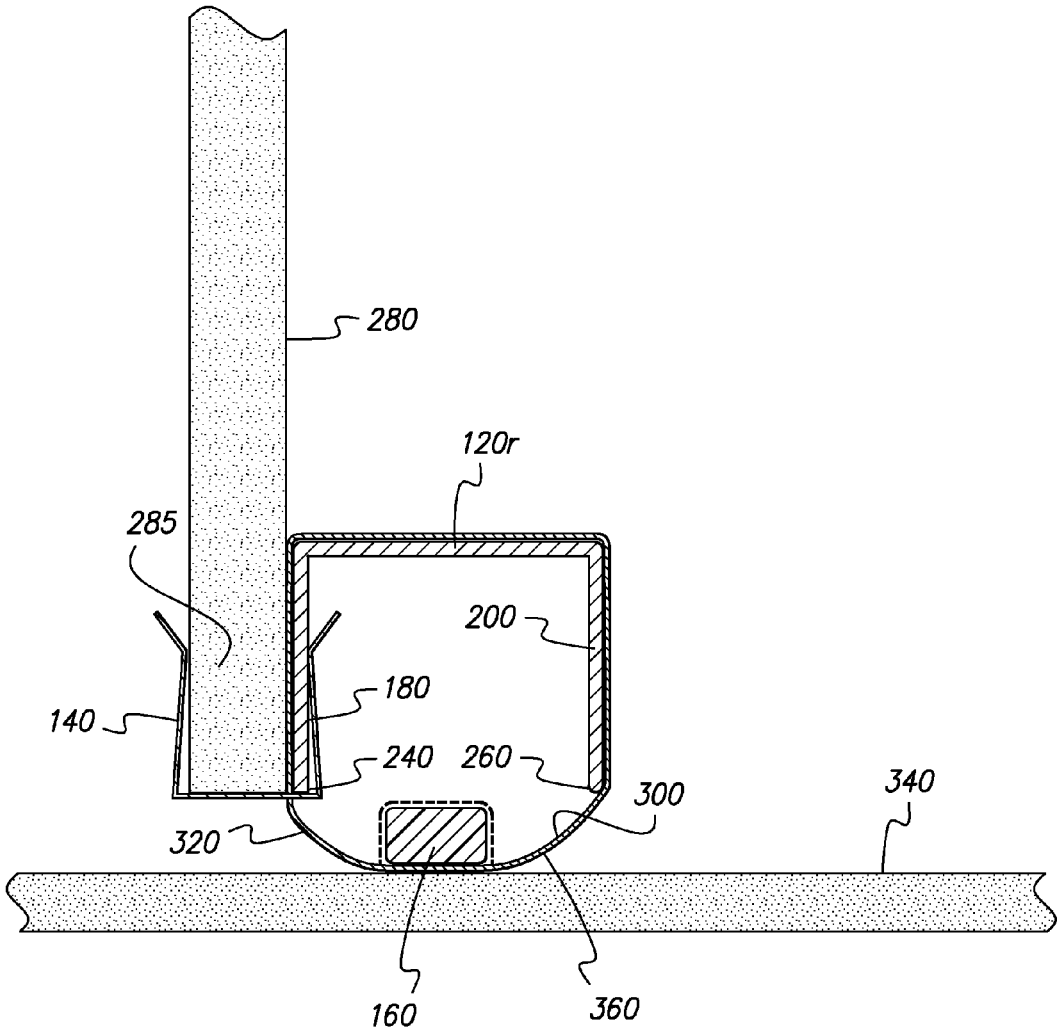
FIG. 4B shows a cross-section environmental view of the draft excluder of FIG. 4 but with an elongated bracket 120*r* having a rectangular profile in place of the elongated bracket 120 shown in FIG. 4, according to the present invention.

In the alternative the elongated angled bracket 120 is replaced with an elongated bracket having a different cross-section shape with, for example, a curved cross-section profile, a rectangular cross-section profile, a regular or irregular polygonal cross-section profile. For example, FIG. 4A shows an elongated bracket incorporating a curved profile (labeled 120*c*), and FIG. 4B shows an elongated bracket incorporating a cross-section having a rectangular profile (labeled 120*r*). Thus, the cross-section profile of the elongated bracket is not limited to a specific cross-section shape and may incorporate any suitable cross-section profile. The brackets 120*c* and 120*r* define an open side between the first and second elongated terminal edges 240 and 260, wherein the first and second elongated terminal edges 240 and 260 extend along at least a portion of the elongated bracket.

Figure 5:
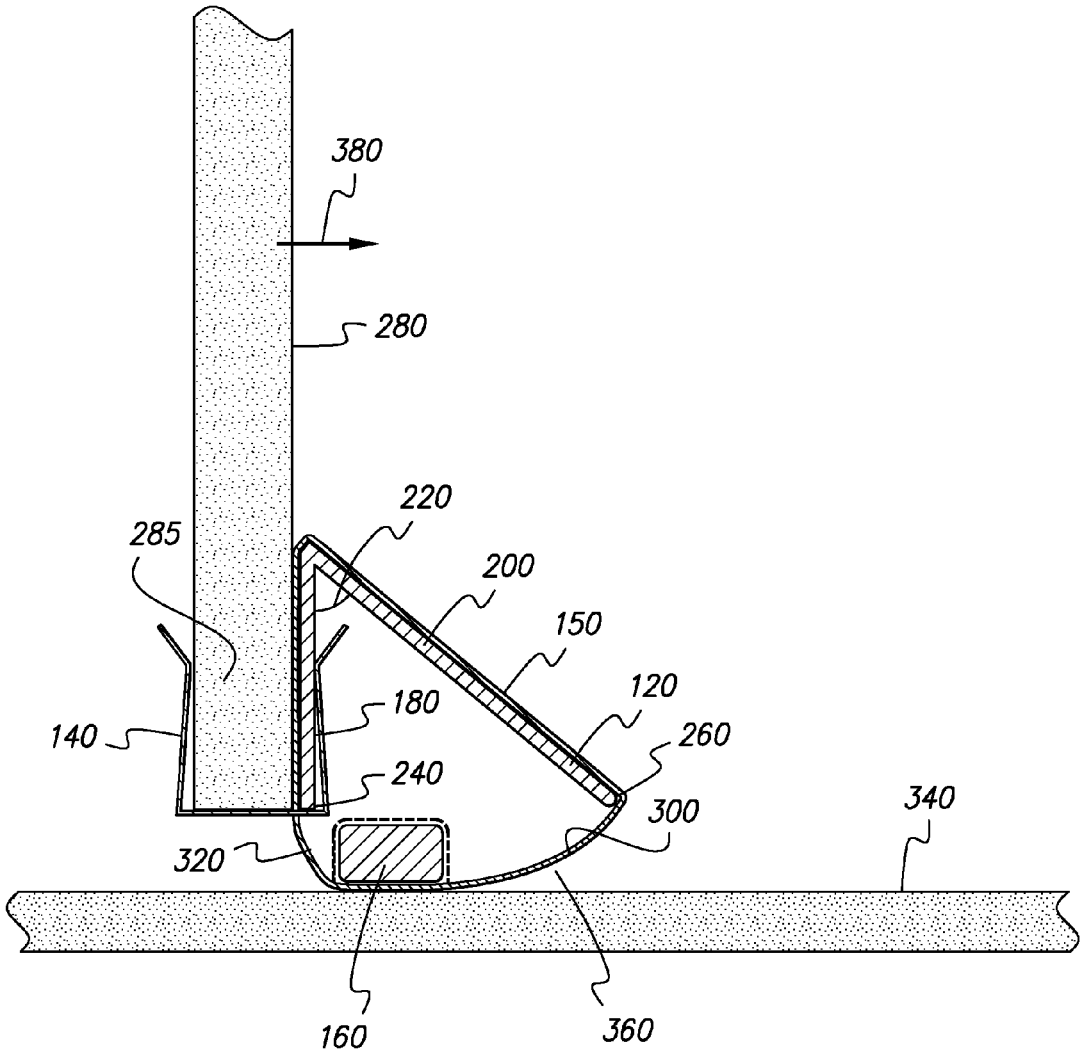
FIG. 5 shows a cross-section environmental view of the draft excluder of FIG. 4 being moved in the direction indicated by arrow 380, according to the present invention.

FIG. 5 shows a cross-section of one embodiment of the draft excluder 100 attached to a door while the door is being moved in the direction indicated by arrow 380. The second sidewall 200 limits the travel of the cover portion 360 and weight 160 thereby preventing the weight 160 and cover portion 360 getting caught under the opening door while a seal is maintained between the cover portion 360 of device 100 and the floor 340. More specifically, the elongated weight 160 facilitates the maintenance of a seal between the cover portion 360 of device 100 and the floor 340. Numeric labels shown in FIG. 5 are described in Table 1 (see FIG. 11).

Figure 6:
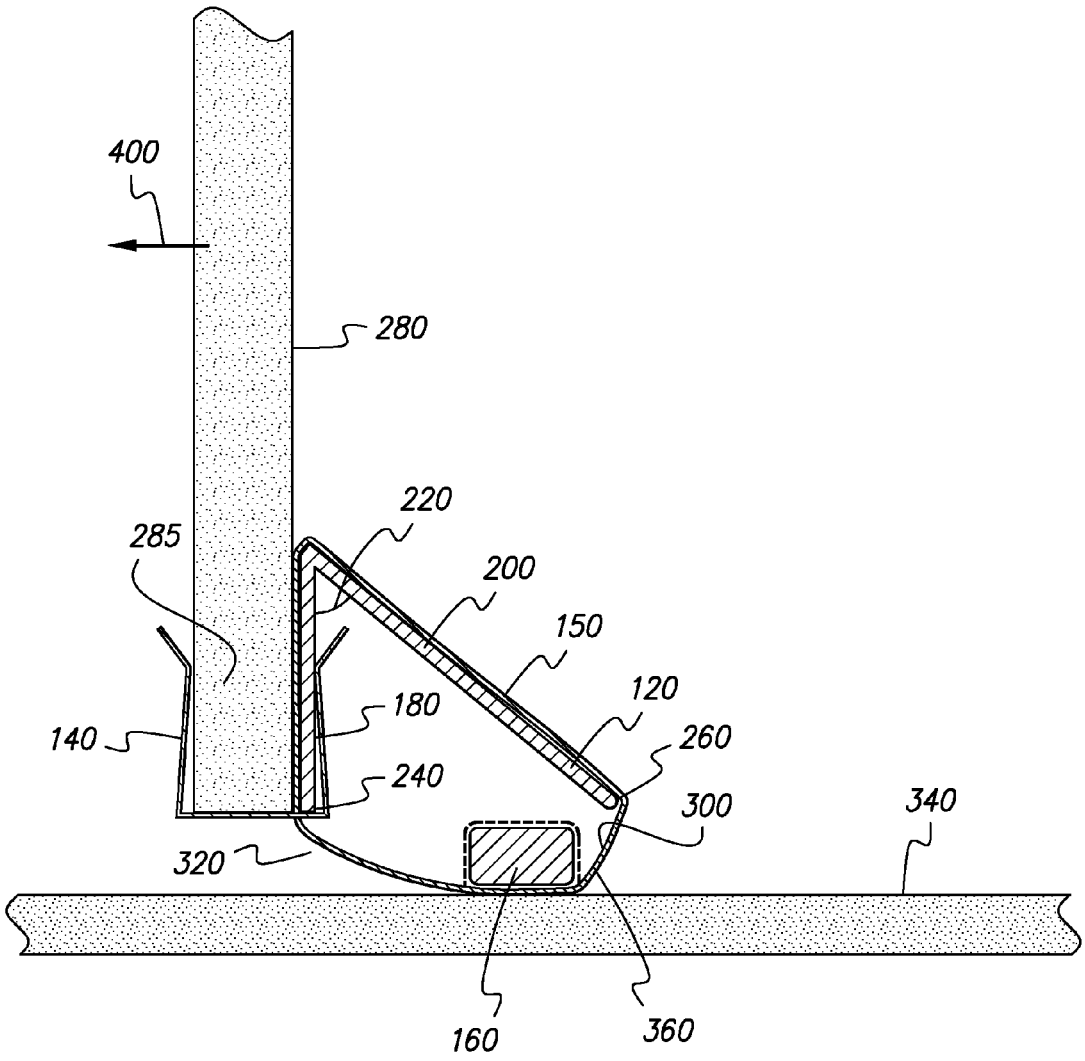
FIG. 6 shows a cross-section environmental view of a draft excluder of FIG. 4 being moved in the direction indicated by arrow 400, according to the present invention.

FIG. 6 shows a cross-section of one embodiment of the draft excluder 100 attached to a door that is being moved in the direction indicated by arrow 400. The first sidewall 180 functions as to limit the travel of the cover portion 360 and weight 160 thereby keeping the weight 160 proximate to second sidewall 200 and between first and second terminal edges 240 and 260 while a seal is maintained between the cover portion 360 of device 100 and the floor 340. The elongated weight 160 facilitates the maintenance of a seal between the cover portion 360 of device 100 and the floor 340. Numeric labels shown in FIG. 6 are described in Table 1 (see FIG. 11).

Figure 7:
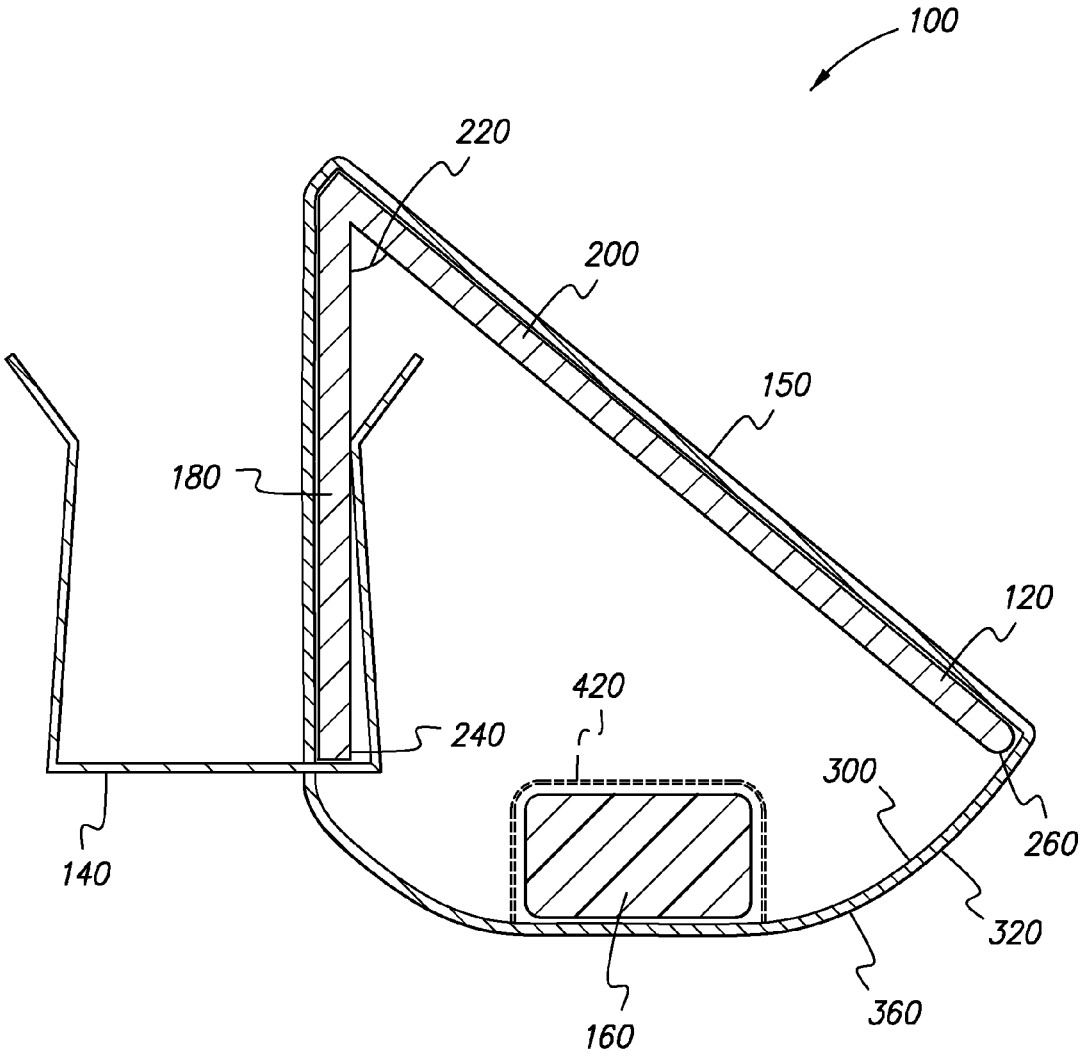
FIG. 7 shows a cross-section view of the draft excluder of FIG. 4 but with an elongated weight 160 shown attached to an interior surface 300 by means of a sleeve 420, according to the present invention.

FIG. 7 shows a cross-section view of one embodiment of the draft excluder 100. The elongated weight 160 is shown attached to the interior of cover portion 360. Specifically, the elongated weight 160 is attached to the interior surface 300 by means of a sleeve 420. Numeric labels shown in FIG. 7 are described in Table 1 (see FIG. 11).

Figure 7A:
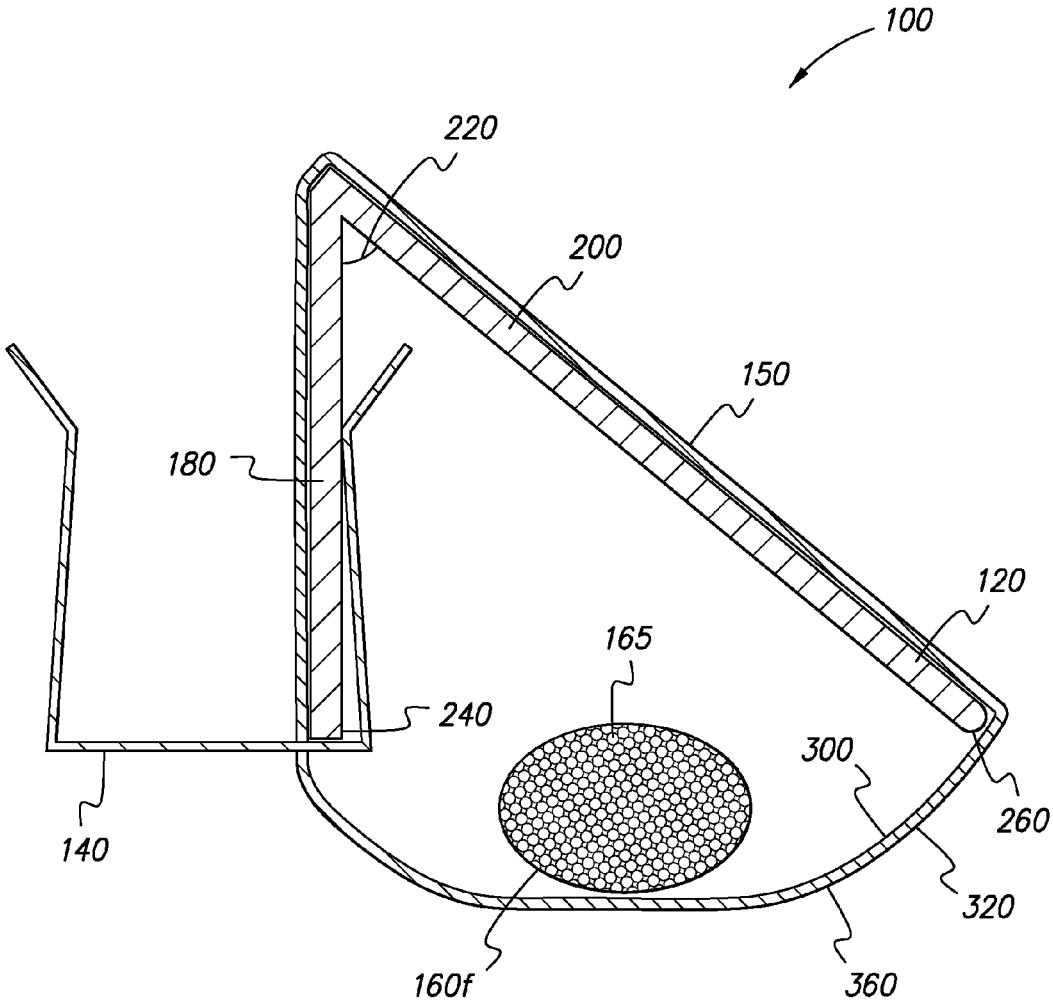
FIG. 7A shows a cross-section view of the draft excluder of FIG. 4 but fitted an elongated weight having an oval cross section shape, according to the present invention.

FIG. 7A shows a cross-section view of one embodiment of the draft excluder 100. The elongated weight (represented in this embodiment by the alpha-numeric label "160*f*") is not permanently attached to the interior surface 300 of cover portion 360. The elongated weight 160*f* can move (e.g., roll) independently of the interior surface 300 as a door is opened or closed, but the elongated weight 160*f* remains located between first and second elongated terminal edges 240 and 260 and in contact with interior surface 300.

Figure 7B:
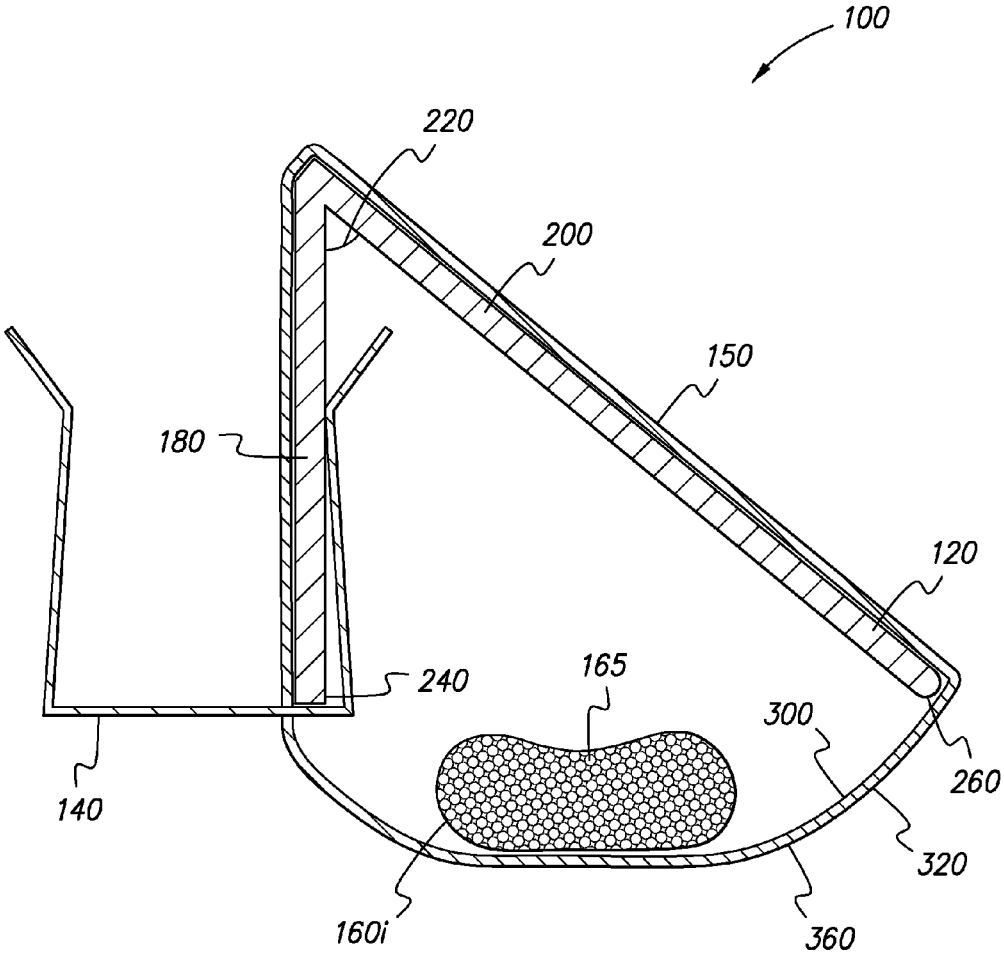
FIG. 7B shows a cross-section view of the draft excluder of FIG. 4 but fitted an elongated weight having a variable cross section shape, according to the present invention.

FIG. 7B shows a cross-section view of one embodiment of the draft excluder 100. The elongated weight (represented in this embodiment by the alpha-numeric label "160*i*") is not permanently attached to the interior surface 300 of cover portion 360. The elongated weight 160*i* can move (e.g., roll) independently of the interior surface 300 as a door is opened or closed, but the elongated weight 160*i* remains located between first and second elongated terminal edges 240 and 260 and in contact with interior surface 300.

Figure 8:
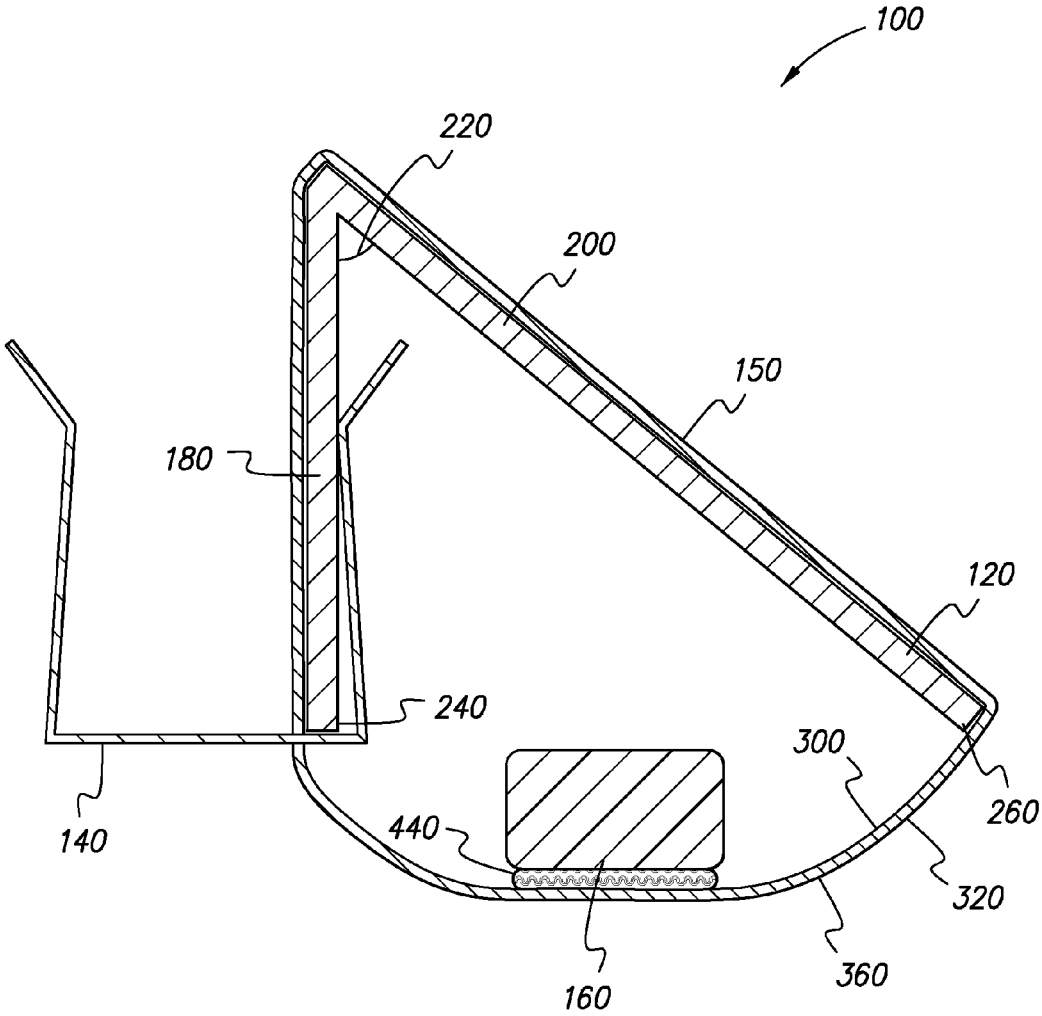
FIG. 8 shows a cross-section view of the draft excluder of FIG. 4 but with a layer of adhesive 440 disposed as shown according to the present invention.

FIG. 8 shows a cross-section view of one embodiment of the draft excluder 100. Adhesive 440 is used to attach the elongated weight 160 to the interior surface 300 of cover portion 360. The adhesive 440 can be any suitable adhesive such as, but not limited to, a polyurethane adhesive such as that described in U.S. Pat. No. 7,253,244 (issued to Gruenewaelder et al), which is incorporated by reference herein in its entirety. The adhesive 440 can be applied as patches or drops, or to create a layer. Numeric labels shown in FIG. 8 are described in Table 1 (see FIG. 11).

Figure 9:
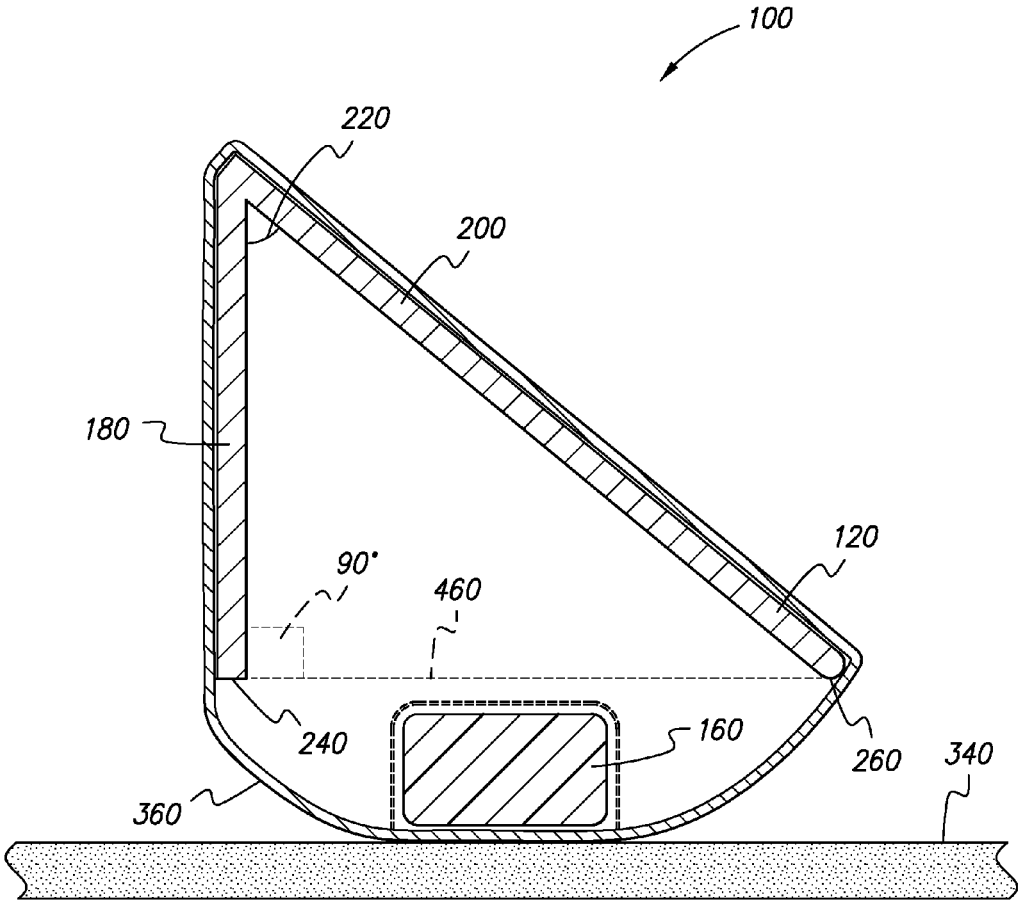
FIG. 9 shows a cross-section view of the draft excluder of FIG. 4 but absent a clip, according to the present invention.

Referring to FIG. 9, in a preferred embodiment the first and second elongated terminal edges 240 and 260 define a virtual plain 460 there-between such that the virtual plain 460 is perpendicular to the first sidewall 180. In this embodiment the first sidewall 180, the second sidewall 200 and the virtual plain 460 in cross-section collectively define a right-angled triangle. The elongated weight 160 can be like that shown in FIGS. 7A and 7B, i.e., not permanently attached by means of, for example, a sleeve 420 to a specific part of interior surface 300; so that the weight 160 can move independently of the interior surface 300 as a door is opened or closed, but the elongated weight 160*f* remains located between first and second elongated terminal edges 240 and 260 and in contact with interior surface 360. Numeric labels shown in FIG. 9 are described in Table 1 (see FIG. 11).

Figure 10:
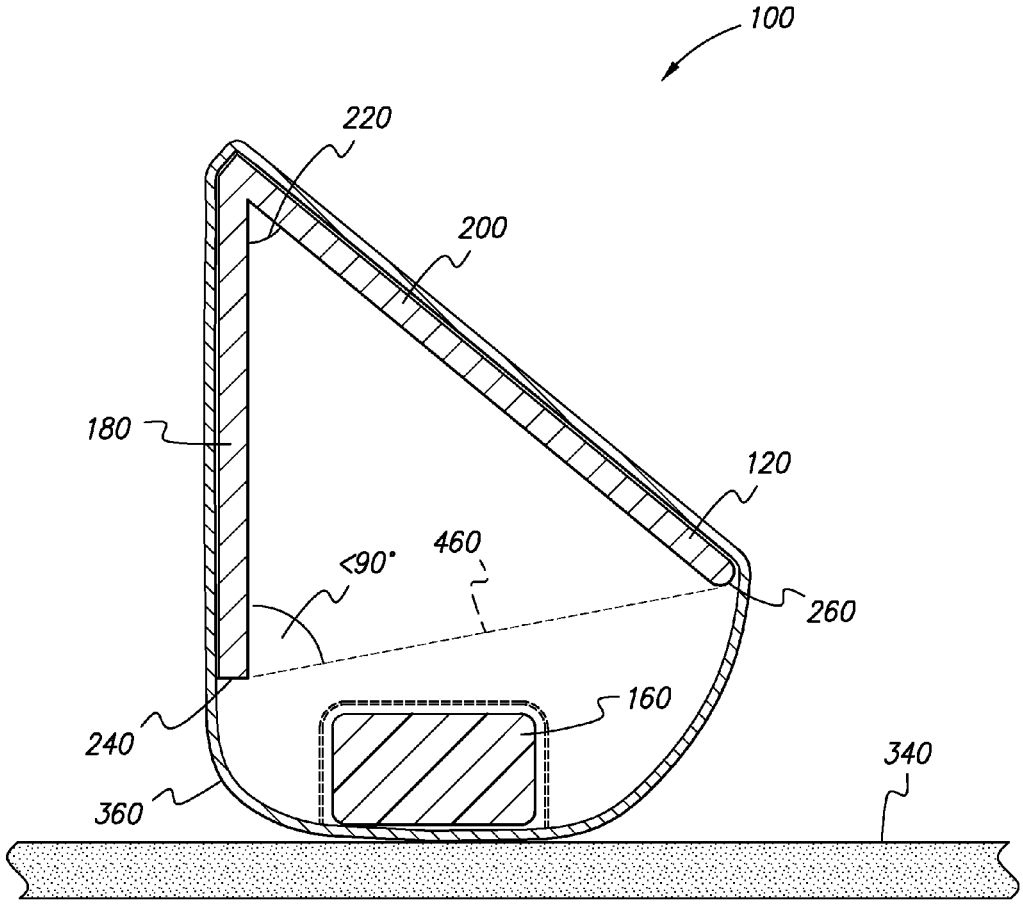
FIG. 10 shows a cross-section view of the draft excluder of FIG. 4 but fitted with a modified bracket, according to the present invention.

Alternatively, the virtual plain 460 is not perpendicular to the first sidewall 180 (see FIG. 10), and the first sidewall 180, the second sidewall 200 and the virtual plain 460 collectively define a non-right-angled triangle in cross-section. In this embodiment, the angle between the virtual plain 460 and first sidewall 180 is in the range 60° to 89°, and more preferably between 80° to 85°. Numeric labels shown in FIG. 10 are described in Table 1 (see FIG. 11).

The draft excluder 100 can be made out of any suitable material. For example, the elongated angled bracket 120 can be made out of metal or metal alloy or plastic or any other suitable material. For example, the at least one clip 140 can be made out of metal or metal alloy or plastic or any other suitable material. For example, the flexible covering 150 can be made out of fabric or flexible plastic or any other suitable material. For example, the elongated weight 160 can be made out of metal (such as, but not limited to, iron or copper or aluminum) or metal alloy (such as, but not limited to, alloys of iron, aluminum, copper or zinc) or plastic or wood or any other suitable material of sufficient density so that when the draft excluder is engaged in normal use there is contact between the cover portion 360 and the floor.

In one embodiment the elongated weight 160 is made out of a bar of cedar wood of sufficient amount to hold the cover portion 360 to the floor. For example, the elongated weight 160 can take the form of a 1"×¾" bar of cedar wood. In another embodiment the elongated weight 160 is actually made up of granules or beads 165 located inside sleeve 420; the granules (or beads) can be made of any suitable material such as, but not limited to, high density polyethylene (HDPE).

Figure 12:
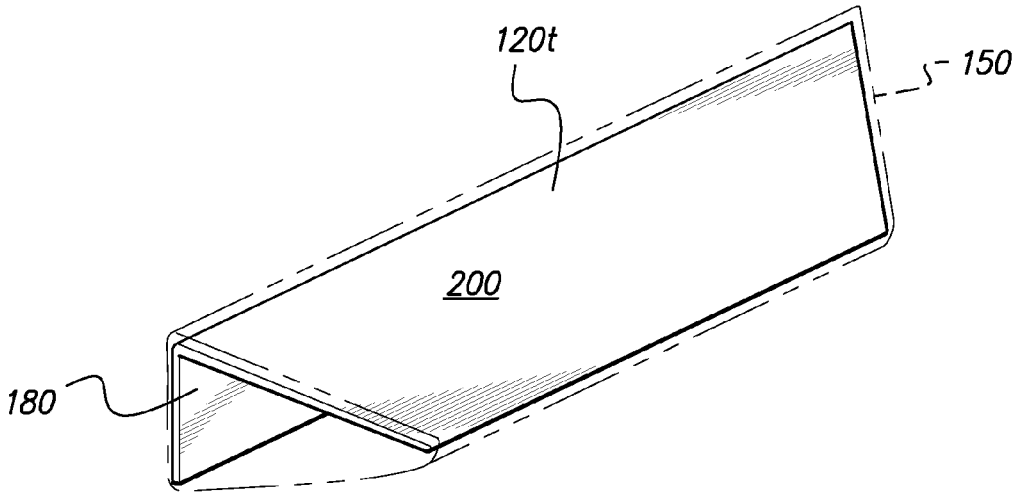
FIG. 12 shows a draft excluder according to the present invention.

FIG. 12 shows an embodiment in which the elongated angled bracket 120 is tapered at both ends (actually represented in FIG. 12 by the alpha-numeric label "120*t*"). This embodiment of the draft excluder 100 is specifically designed to avoid contact with door frames to allow the door to be opened more than 90°. The tapered opposite ends of bracket 120*t* also helps to prevent unwanted contact with, for example, an adjoining door in a double-door setup. Alternatively, only one end of the elongated angled bracket 120 is tapered.

It is to be understood that the present invention is not limited to the embodiments described above, but encompasses any and all embodiments within the scope of the following claims.

What is claimed:

1. A draft excluder for excluding drafts underneath doors, comprising:

an elongated angled bracket said bracket made up of first and second sidewalls with an interior angle there-between, said interior angle having a value of between 5° and 85°, said first and second sidewalls respectively define first and second elongated terminal edges;

at least one clip, which during normal use of said draft excluder holds the first sidewall of said bracket to the bottom of a door such that the interior angle faces downward towards the floor beneath the door;

a flexible covering, said flexible covering defines a cover portion that extends between said first and second elongated terminal edges, wherein said cover portion defines an interior surface; and an elongated weight affixed to the interior surface of said cover portion, and which during normal operation of said draft excluder said weight remains located between said first and second elongated terminal edges, wherein said second sidewall of said elongated angled bracket defines opposite tapered ends.

2. The draft excluder according to claim 1 further comprising a sleeve to affix said elongated weight to said internal surface of said cover portion.

3. The draft excluder according to claim 1, wherein said interior angle is 45°.

* * * * *